US007395020B1

(12) United States Patent
Gila et al.

(10) Patent No.: US 7,395,020 B1
(45) Date of Patent: Jul. 1, 2008

(54) IMAGING METHODS, IMAGING DEVICES, TRANSFER ASSEMBLIES, AND TRANSFER MEMBER LUBRICATION ASSEMBLIES

(75) Inventors: Omer Gila, Cupertino, CA (US); Michael H. Lee, San Jose, CA (US); Manoj Bhattacharyya, Cupertino, CA (US); Shahar Stein, Petach-Tikva (IL); Itzhak Ashkenazi, Kffar Gibbton (IL); Yael Kowal, Tel Aviv (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/414,772

(22) Filed: Apr. 28, 2006

(51) Int. Cl.
*G03G 15/01* (2006.01)

(52) U.S. Cl. ..... 399/302; 399/308

(58) Field of Classification Search ..... 399/237, 399/302, 308
See application file for complete search history.

(56) References Cited

U.S. PATENT DOCUMENTS 6,998,210 B2 2/2006 Yoshimura et al.
7,010,259 B2 3/2006 Gila et al.
7,035,567 B2 4/2006 Gila et al.
2002/0051655 A1 * 5/2002 Maruta et al. ..... 399/227
2003/0044203 A1 * 3/2003 Watanabe ..... 399/302
2003/0059226 A1 3/2003 Iida et al.
2003/0215269 A1 11/2003 Kayahara et al.

FOREIGN PATENT DOCUMENTS

EP 0399186 A 11/1990

OTHER PUBLICATIONS

"HP Indigo Digital Printing", Hewlett Packard Company, 2003.

* cited by examiner

*Primary Examiner*—David M. Gray
*Assistant Examiner*—Geoffrey T Evans

(57) ABSTRACT

Imaging methods, imaging devices, transfer assemblies, and transfer member lubrication assemblies are described according to some aspects. According to one aspect, an imaging method includes forming a latent image using a first imaging member, using a marking agent, developing the latent image providing a developed image, after the developing, first transferring the marking agent of the developed image to an imaging transfer member, after the first transferring, second transferring the marking agent of the developed image from the imaging transfer member, and lubricating the imaging transfer member during the first and the second transferrings.

35 Claims, 5 Drawing Sheets

IMAGING METHODS, IMAGING DEVICES, TRANSFER ASSEMBLIES, AND TRANSFER MEMBER LUBRICATION ASSEMBLIES

FIELD OF THE DISCLOSURE

Some aspects of the disclosure relate to imaging methods, imaging devices, transfer assemblies, and transfer member lubrication assemblies.

BACKGROUND

Imaging devices capable of printing images upon paper and other media are becoming increasingly popular and used in many applications including color reproduction. For example, laser printers, ink jet printers, and digital printing presses are but a few examples of imaging devices in wide use today for black and white or color imaging.

Digital printing presses are relatively new compared with other printing technologies and may be used in place of other printing arrangements, such as analog printing presses. In one imaging example utilizing a press, a plurality of copies of the same image may be reproduced in relatively high volumes (e.g., printing business cards, catalogs, publications, etc.). Some analog systems may have relatively long set up times for different jobs to be imaged. In these implementations, it may not be desired to use analog systems if a relatively small number of copies of the job are to be reproduced.

SUMMARY

According to some aspects of the disclosure, exemplary imaging methods, imaging devices, transfer assemblies, and transfer member lubrication assemblies are described.

According to one embodiment, an imaging method comprises forming a latent image upon a first imaging member, developing the latent image providing a developed image, after the developing, first transferring the developed image to an imaging transfer member, after the first transferring, second transferring the developed image from the transfer member, and lubricating the transfer member during the first and the second transferrings.

According to another embodiment, an imaging device comprises an imaging member configured to provide latent images during imaging operations of the imaging device, a development assembly configured to develop the latent images of the imaging member using a marking agent to provide developed images corresponding to the latent images, an imaging transfer member configured to transfer the developed images from the imaging member, and a lubrication assembly configured to lubricate the transfer member during the transfer of the developed images using the transfer member.

Other embodiments are described in the disclosure.

DETAILED DESCRIPTION

At least some aspects of the disclosure pertain to imaging methods, imaging devices, transfer assemblies, and transfer member lubrication assemblies. Some more specific embodiments relate to methods and apparatus for implementing imaging operations of hard images upon media, such as forming color images upon paper. As discussed further below, some aspects of the disclosure relate to printing using a digital printing press, for example, configured to perform relatively high volume color printing in one embodiment. In exemplary embodiments discussed below, methods and apparatus of providing a lubricant during imaging operations are provided. The usage of the lubricant reduces friction and assists with the release of developed images in at least some of the embodiments discussed in further detail below. Some aspects of the disclosure are discussed with respect to an exemplary electrophotographic imaging process and apparatus although other imaging configurations for forming hard copy images upon media are possible.

Figure 1:
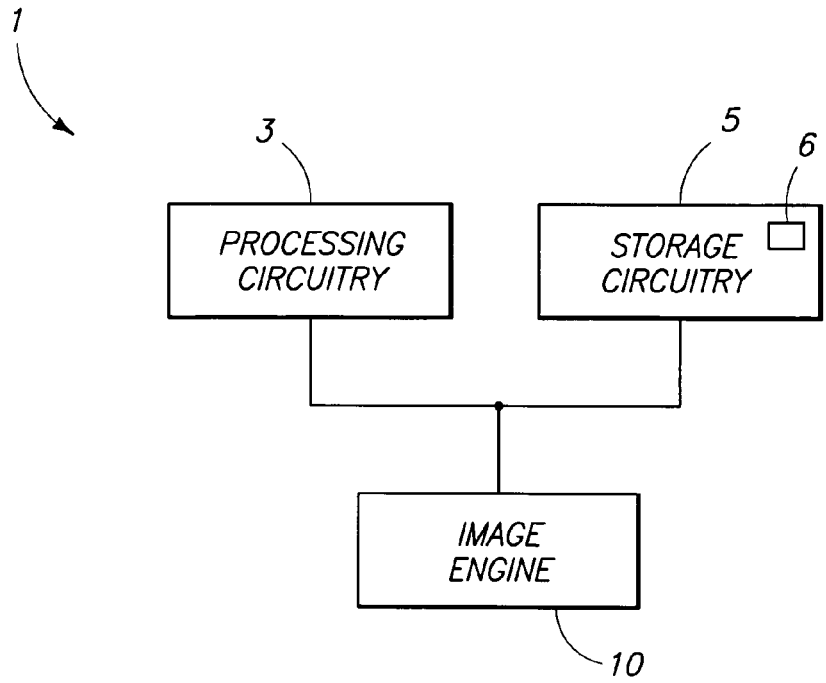
FIG. 1 is a functional block diagram of an imaging device according to one embodiment.

Referring to FIG. 1, an illustrative representation of an imaging device 1 is depicted. In one embodiment, the imaging device 1 may be configured as a digital imaging device configured to access digital image data to form hard copy images upon media, such as paper, labels, transparencies, etc. For example, the imaging device 1 may be configured as a color digital press, such as an HP Indigo 5000 color digital printing press available from Hewlett-Packard Company, in one exemplary arrangement.

Imaging device 1 includes processing circuitry 3, storage circuitry 5, and an image engine 10 in the depicted exemplary configuration. Other configurations of imaging device 1 are possible in other embodiments including more, less or alternative components.

In one embodiment, processing circuitry 3 is arranged to process data (e.g., access and process digital image data corresponding to a color image to be hard imaged upon media), control data access and storage, issue commands, monitor imaging operations and control imaging operations of imaging device 1. Processing circuitry 3 may comprise circuitry configured to implement desired programming provided by appropriate media in at least one embodiment. For example, the processing circuitry 3 may be implemented as one or more of a processor and/or other structure configured to execute executable instructions including, for example, software and/or firmware instructions, and/or hardware circuitry. Exemplary embodiments of processing circuitry 3 include hardware logic, PGA, FPGA, ASIC, state machines, and/or other structures alone or in combination with a processor. These examples of processing circuitry 3 are for illustration and other configurations are possible.

The storage circuitry 5 is configured to store programming such as executable code or instructions (e.g., software and/or firmware), electronic data (e.g., image data), databases, look up tables, or other digital information and may include processor-usable media. Processor-usable media includes any computer program product or article of manufacture 6 which can contain, store, or maintain programming, data and/or digital information for use by or in connection with an instruction execution system including processing circuitry in the exemplary embodiment. For example, exemplary processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

At least some embodiments or aspects described herein may be implemented using programming stored within appropriate storage circuitry 5 described above and/or communicated via a network or using other transmission media and configured to control appropriate processing circuitry 3. For example, programming may be provided via appropriate media including for example articles of manufacture 6, embodied within a data signal (e.g., modulated carrier wave, data packets, digital representations, etc.) communicated via an appropriate transmission medium, such as a communications network (e.g., the Internet and/or a private network), wired electrical connection, optical connection and/or electromagnetic energy, for example, via a communications interface (not shown), or provided using other appropriate communication structure or medium. Exemplary programming including processor-usable code may be communicated as a data signal embodied in a carrier wave in but one example.

Image engine 10 is configured to implement electrophotographic imaging operations to form and develop latent images in one possible embodiment. Other imaging techniques or methods may be used to form images in other embodiments.

In the embodiment discussed in further detail below, image engine 10 is configured to implement electrophotographic imaging operations to form latent images responsive to image data and develop the latent images using marking agents of a plurality of different colors. In one illustrative embodiment, the marking agents may be provided in liquid form individually including a liquid carrier (e.g., Isopar L™ available from ExxonMobil Corporation) and one of a plurality of different colors of ink or toner (e.g., respective colors of CMYK in one example) which may be provided by respective reservoirs or tanks. One possible liquid marking agent is ElectroInk® available from Hewlett-Packard Company and as described in "HP Indigo Digital Printing", Hewlett Packard Company, 2003, the teachings of which are incorporated herein by reference. Other marking agents may be used in other embodiments and other configurations of image engine 10 are possible.

Figure 2:
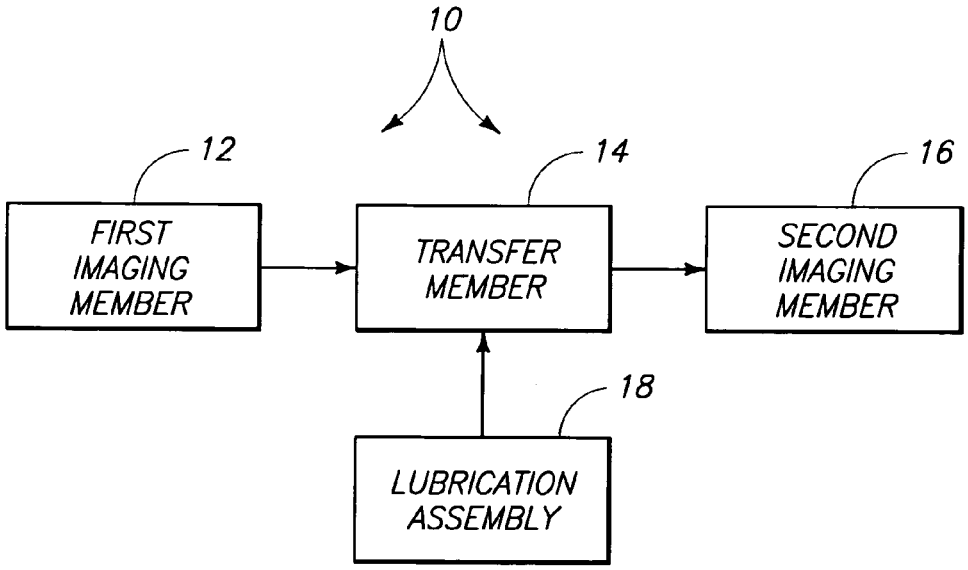
FIG. 2 is a functional block diagram of an image engine according to one embodiment.

Referring to FIG. 2, additional details of an image engine 10 configured according to the above-described exemplary embodiment are described in one possible implementation. In FIG. 2, image engine 10 includes a first imaging member 12, a transfer member 14, a second imaging member 16 and a lubrication assembly 18.

As mentioned previously, image engine 10 may be arranged to implement electrophotographic and imaging operations in one embodiment. First imaging member 12 is configured to form or provide latent images corresponding to hard images to be formed upon media. As discussed below with respect to a more specific example of image engine 10 described with respect to FIG. 3, first imaging member 12 may be a photoconductive device (e.g., drum or belt) having an electrical charge and a laser or other writing head may be used to selectively discharge portions of the first imaging member 12 to form latent images thereon. Thereafter, the latent images may be developed on first imaging member 12, for example, using marking agents, to provide developed images.

Transfer member 14 may be utilized to transfer the developed images in an exemplary imaging device and may be referred to as an imaging transfer member in at least one configuration. In one embodiment, transfer member 14 may be arranged as an intermediate transfer drum, belt or other suitable structure and may also be referred to as a blanket. In the described implementation, transfer member 14 receives developed images from first imaging member 12 in a first transfer operation and transfers the developed images to second imaging member 16 in a second transfer operation. Transfer member 14 may have an outer surface comprising a relatively soft material, such as silicone rubber or polyurethane, in one embodiment. As discussed in detail below, a lubricant may be applied to the outer surface of transfer member 14 to protect transfer member 14. The lubricant may be provided during imaging operations including during the first and second transfer operations of developed images in one embodiment.

In one embodiment, second imaging member 16 may be media for forming hard copy print images and the transfer member 14 may transfer the developed images directly to the media. In other embodiments, second imaging member 16 may be configured in other different arrangements for receiving developed images, and may be an additional transfer drum in but one example. The second imaging member 16 is downstream from transfer member 14 and may be referred to as a subsequent imaging member is some embodiments.

In some configurations, transfer member 14 may be susceptible to damage. In one embodiment, lubrication assembly 18 is arranged to provide a lubricant to transfer member 14 during imaging operations. For example, in one configuration, lubrication assembly 18 may provide the lubricant directly to the outer surface of the transfer member 14 which is used to transfer developed images. An exemplary lubricant is a lubricating oil or a solid lubricant. In one embodiment, a lubricating oil may comprise an oil having a relatively high molecular weight (e.g., 200-400 amu). For example, the molecular weight of a lubricating oil should be higher than the molecular weight of the liquid carrier of the marking agent in one implementation. In such an implementation, the lubricating oil will remain upon the surface of the transfer member 14 after the carrier has evaporated (e.g., the carrier may comprise 80% of the marking agent at the first transfer and only 5% of the marking agent at the second transfer with the remainder being ink solids).

In some embodiments, it may be possible to apply lubricant intermittently to the surface of transfer member 14 if the lubricant remains on the surface of transfer member 14 for sufficient periods of time. Also, if plural development rotations of transfer member 14 are used to develop an image (e.g., four rotations to apply four colorants of a CMYK process), the lubrication assembly 18 may be configured to only apply the lubricant at a first moment in time before the first rotation of transfer member 14 to apply the lubricant intermediate the transfer member 14 and the marking agent of the image and thereafter at a second moment in time not apply additional lubricant until the next image. The lubrication assembly 18 may be disengaged from contacting the transfer member 14 during periods of time wherein no lubricant is provided to the transfer member 14. In other embodiments, the lubricant is provided continuously to the outer surface of the transfer member 14 during imaging operations.

As discussed in further detail below, the lubricant may assist with one or more of reduction of friction (e.g., reduce friction between media and portions of transfer member 14 which do not include marking agents (i.e., background areas of a developed image) in arrangements where the media contacts the transfer member 14) and release of developed images from transfer member 14 to media. The lubricant may increase releasability of developed images from transfer member 14 compared to arrangements not using a lubricant inasmuch as the lubricant may be provided intermediate an outer surface of transfer member 14 and the developed images and the lubricant may reduce adhesion of the developed images to the outer surface. The operating temperatures may affect the type of lubricant utilized and the lubricant is selected in one implementation for use with the transfer member 14 operating at temperatures in a range from 100 C-180 C. A lubricant suitable for use with the exemplary liquid marking agents described above has product designation Isopar V™ available from ExxonMobil Corporation although other lubricants may be used. Exemplary configurations of lubrication assembly 18 are discussed below with respect to the embodiments of transfer assemblies depicted in FIGS. 4A-4D.

Figure 3:
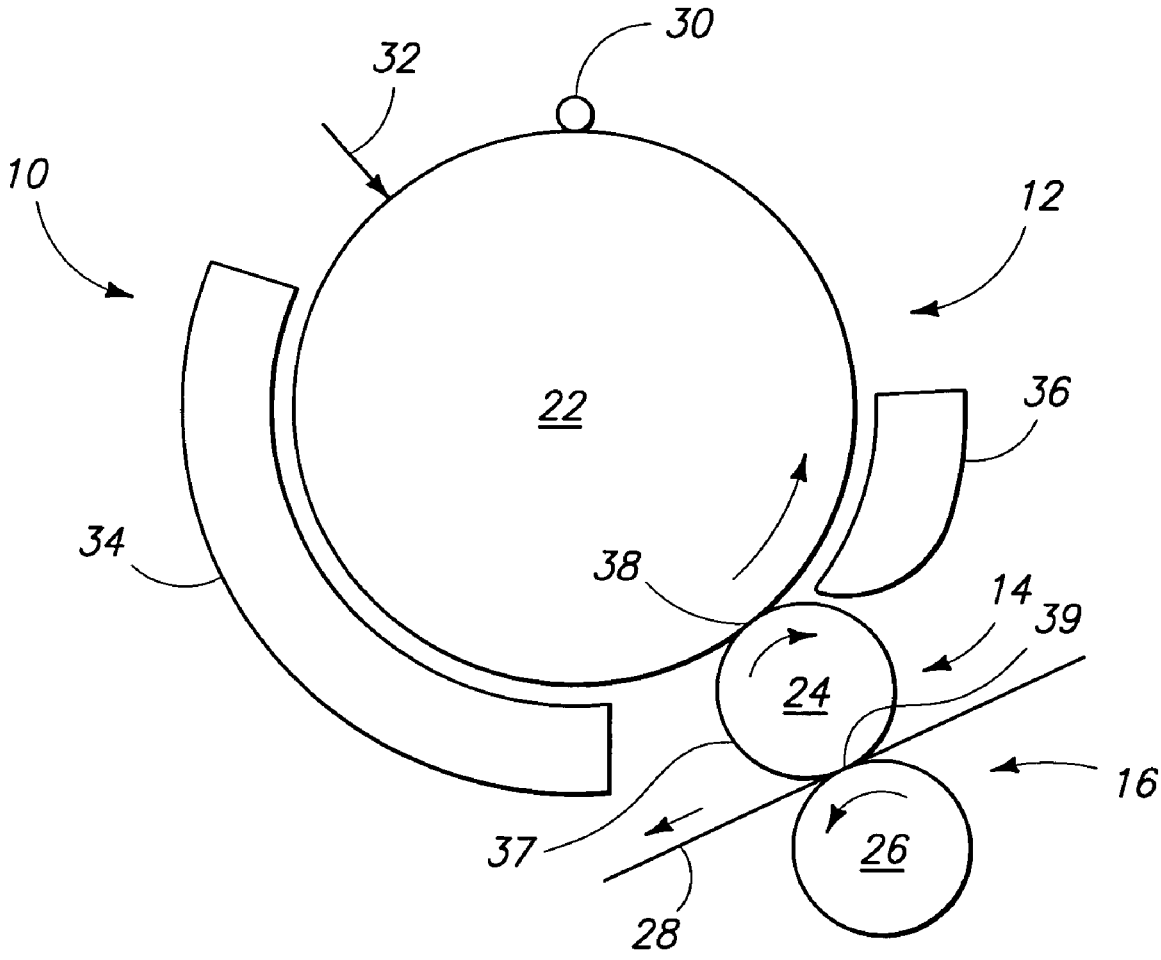
FIG. 3 is an illustrative representation of an image engine according to one embodiment.

Referring to FIG. 3, additional details of an exemplary electrophotographic image engine 10 configured to implement printing is shown according to one embodiment. In the illustrated exemplary configuration, first imaging member 12, transfer member 14 and second imaging member 16 of image engine 10 are implemented as a photoconductive drum 22, intermediate transfer drum 24 and impression drum 26, respectively. Other configurations of image engine 10 are possible.

Photoconductive drum 22 is arranged to rotate in a counterclockwise direction during imaging operations. A charge roller 30 is arranged to provide an electrical charge upon a photoconductive surface of drum 22 and a writing head (not shown) may generate a laser beam 32 to selectively discharge portions of the charged surface of drum 22 to form latent images. Processing circuitry 3 may access and generate appropriate image data to control the writing head to form desired images in one embodiment. A development assembly 34 may contain a plurality of developers to provide marking agents to the surface of drum 22 to develop the latent images formed thereon. In some exemplary color implementations, the marking agents may be provided simultaneously or in different separations. Following development using the marking agent(s), developed images are transferred to intermediate transfer drum 24 as described further below. A cleaning station 36 may be provided to remove any marking agent not transferred to drum 24 and thereafter subsequent latent images may be formed and developed.

In the illustrated embodiment, media 28 traveling along a paper path of imaging device 1 passes between intermediate transfer drum 24 and impression drum 26. The intermediate transfer drum 24 transfers developed images from photoconductive drum 22 to media 28 in the depicted embodiment. According to the illustrated arrangement of imaging device 1, the media 28 may receive a plurality of colors of different separations on a single pass through drums 24, 26. In other embodiments, different color separations may be separately applied to photoconductive drum 22 in respective revolutions of drum 22. Alternative configurations of imaging device 1 in addition to the arrangement of FIG. 3 including different configurations of members 12, 14, 16 are possible in other embodiments. For example, one or both of first imaging member 12 and transfer member 14 may be individually implemented as a belt instead of a drum as described with respect to the exemplary embodiment of FIG. 3.

Although not shown in FIG. 3, lubrication assembly 18 may be included to provide a lubricant to intermediate transfer drum 24 during imaging operations. Exemplary arrangements of possible lubrication assemblies 18 which may be used according to illustrative embodiments are described below with respect to the transfer assemblies of FIGS. 4A-4D. The illustrated lubrication assemblies 18 of FIGS. 4A-4D may provide the lubricant as a film layer upon the outer surface of drum 24. For example, the lubricant film layer may have a submicron thickness upon the outer surface of drum 24 in a range of 0.001-0.1 microns in exemplary embodiments. The lubricant may be diluted to achieve a desired thickness of the film layer upon the surface of drum 24 (e.g., a lubricating oil of 95% Isopar L™ and 5% Isopar V™) in one embodiment. As discussed below with respect to FIGS. 4A-4D, exemplary lubrication assemblies 18 may individually include a supply device configured to supply the lubricant and a transport assembly configured to transport the lubricant from the supply device to the transfer member 14.

In one embodiment described with respect to FIG. 3, the lubricant may be provided to an outer surface of transfer member 14 in a manner described with reference to spatial locations 37, 38, 39 of the path of rotation of the outer surface of transfer member 14. In the exemplary clockwise rotation of transfer member 14 of FIG. 3, spatial location 37 may be considered to be upstream of location 38 and downstream of location 39.

For example, although not shown in FIG. 3, the lubrication assembly 18 may apply the lubricant to portions of the outer surface of transfer member 14 located at location 37 during rotations of transfer member 14 and intermediate locations 38, 39. Locations 38, 39 correspond to respective nips wherein developed images are received by transfer member 14, and released from transfer member 14, respectively. In one embodiment, locations 38, 39 may be referred to as first and second locations and location 37 may be a third location. A portion of the outer surface receiving the lubricant thereafter rotates to location 38 wherein developed images are transferred to transfer member 14. Thereafter, portions of the outer surface having the developed images are rotated to location 39 wherein the developed images are again transferred, for example, to media 28. In one embodiment, the transfer member 14 transfers the developed images from member 14 directly to media 28.

In accordance with the described exemplary implementation, the lubricant is applied to portions of the outer surface of the transfer member 14 which are void of the marking agents of the developed images. More specifically, in the depicted example, the lubricant may be provided to portions of the outer surface prior to the receipt of developed images at location 38 and after developed images have been transferred from transfer member 14 at location 39. In one embodiment, the lubricant is provided intermediate the outer surface of the transfer member 14 and the developed images which are received on top of the lubricant upon the outer surface.

Figure 4A:
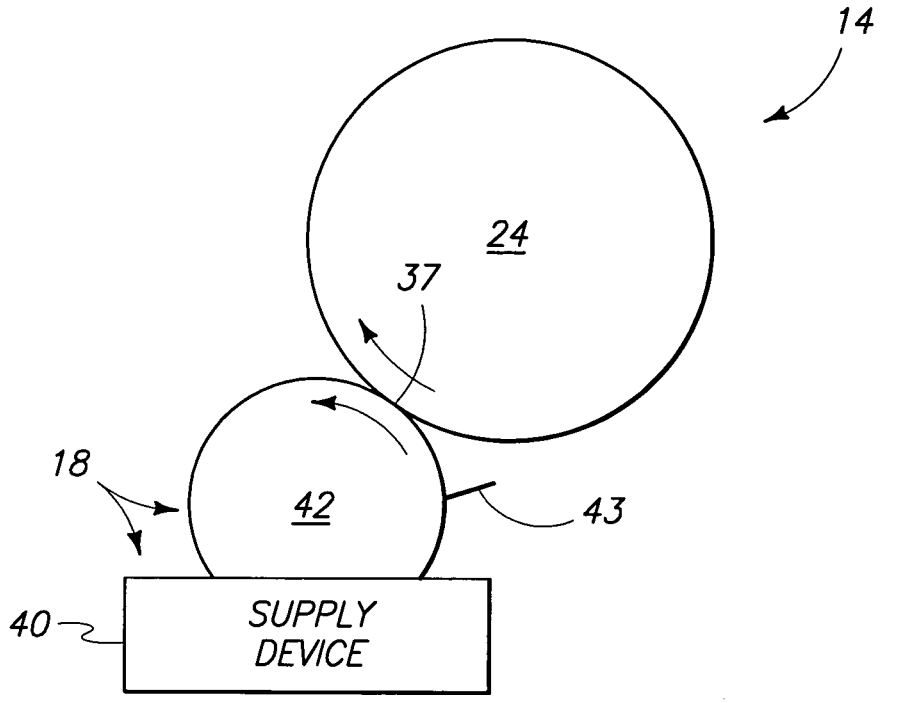
FIGS. 4A-4D are illustrative representations of transfer assemblies of image engines according to exemplary embodiments.

Referring to FIG. 4A, a lubrication assembly 18 configured according to one embodiment is shown. In FIG. 4A, lubrication assembly 18 includes a supply device 40, a wetting roller 42 and a blade 43. In the depicted arrangement, a transport assembly in the form of wetting roller 42 is used to transport the lubricant from the supply device 40 to an outer surface of the transfer member 14. In one embodiment, wetting roller 42 may be partially immersed within supply device 40 which may be implemented as a reservoir configured to supply the lubricant. The wetting roller 42 may contact an outer surface of transfer drum 24 (i.e., which is configured to receive the developed images) to apply lubricant to drum 24 in the illustrated embodiment. Wetting roller 42 may rotate with transfer drum 24 and transfer lubricant from supply device 40 to the outer surface of drum 24 during imaging operations. In one embodiment, wetting roller 42 may be constructed of metal, plastic or other material.

Blade 43 may be positioned adjacent to an outer surface of wetting roller 42 and configured to control the thickness of a layer of lubricant provided upon the outer surface of wetting roller 42. Blade 43 may be positioned to provide a thickness of the layer of lubricant in a range of 0.1-0.001 microns upon wetting roller 42 in the illustrated configuration although other thicknesses may be provided in other embodiments.

Figure 4B:
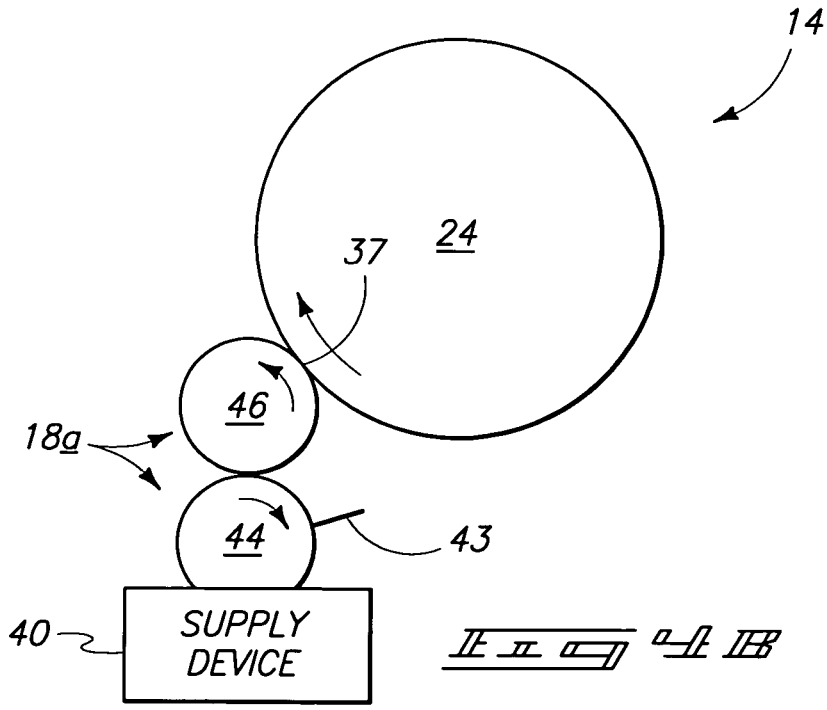

Referring to FIG. 4B, another possible arrangement of lubrication assembly 18*a* is shown. Lubrication assembly 18*a* includes supply device 40, blade 43, a first wetting roller 44 and a second wetting roller 46. Rollers 44, 46 may form a transport assembly in the embodiment of FIG. 4B. First wetting roller 44 may comprise a metal roller and second wetting roller 46 may comprise a non-heat conductive material (e.g., plastic) in one embodiment. First wetting roller 44 is arranged to transfer lubricant from supply device 40 to second wetting roller 46 which contacts and applies the lubricant to an outer surface of intermediate transfer drum 24. Furthermore, in other arrangements, a blade (not shown) may be provided adjacent to roller 46.

Figure 4C:
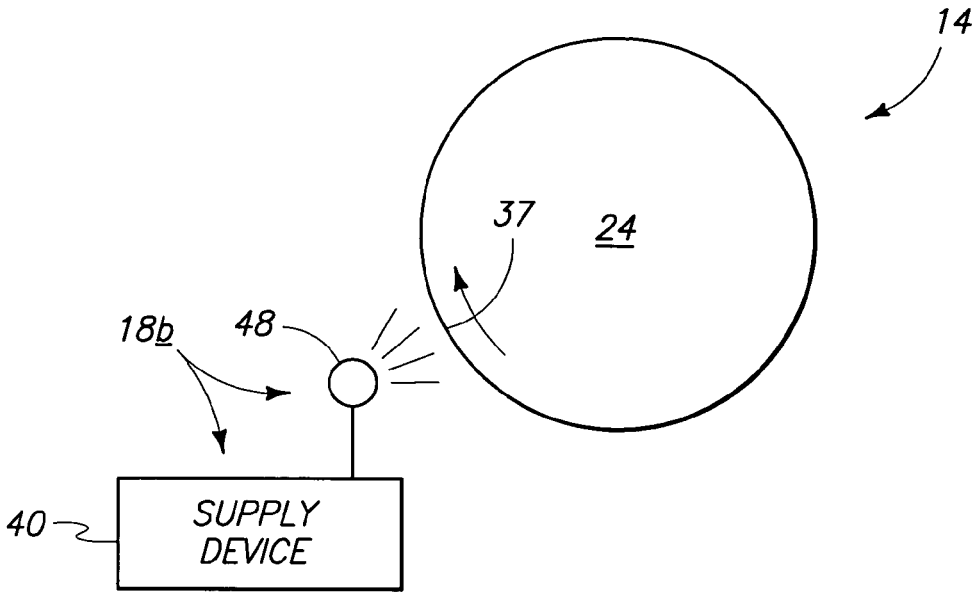

Referring to FIG. 4C, another possible arrangement of lubrication assembly 18*b* is shown. Lubrication assembly includes supply device 40 and a transport assembly in the form of a spray nozzle 48 spaced from transfer drum 24. Although not shown, a pump may be coupled with spray nozzle 48 to spray the lubricant upon the outer surface of intermediate transfer drum 24.

Figure 4D:
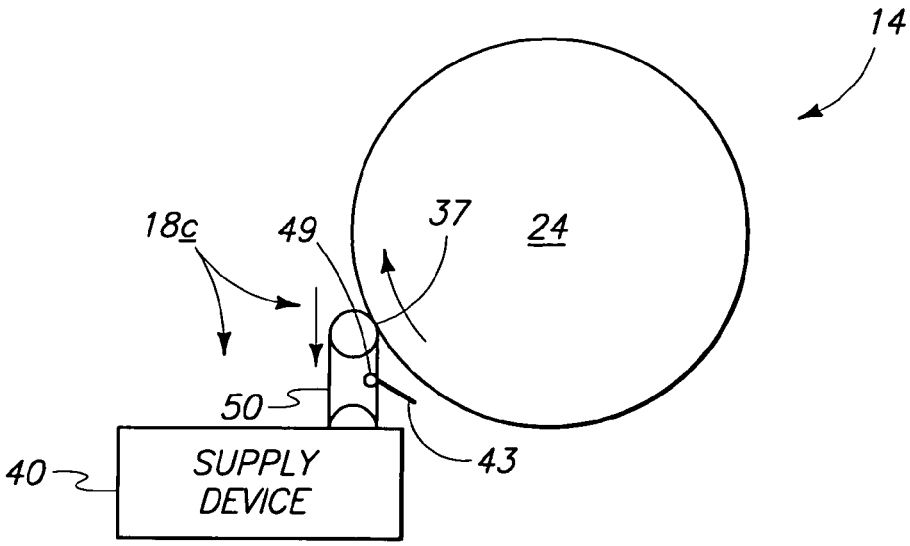

Referring to FIG. 4D, another lubrication assembly 18*c* is illustrated. The depicted lubrication assembly 18*c* includes supply device 40 and a transport assembly comprising a belt 50. A portion of belt 50 may be immersed in supply device 40 to transfer the lubricant from supply device 40 to the outer surface of intermediate transfer drum 24 in the depicted embodiment. Belt 50 may be implemented as a belt comprising a Kapton™ base material available from E. I. du Pont de Nemours and Company coated with silicone rubber or polyurethane. A roller 49 may be positioned in an opposing relationship with respect to blade 43 in one embodiment to reduce or minimize deflection of belt 50 caused by blade 43.

Although not shown in FIGS. 4A-4B and 4D, respective assemblies may be provided to move respective lubrication assemblies 18, 18*a*, 18*c* with respect to the intermediate transfer drum 24. For example, it may be desired to move lubrication assemblies 18, 18*a*, 18*c* with respect to drum 24 so assemblies 18, 18*a*, 18*c* contact intermediate transfer drum 24 (as shown in FIGS. 4A-4B and 4D) during imaging operations and are spaced from the outer surface of drum 22 during moments in time when imaging does not occur (e.g., lubrication assemblies 18, 18*a*, 18*c* may be moved to positions wherein no portions of the lubrication assemblies 18, 18*a*, 18*c* contact the drum 24 when no imaging occurs).

Figure 5:
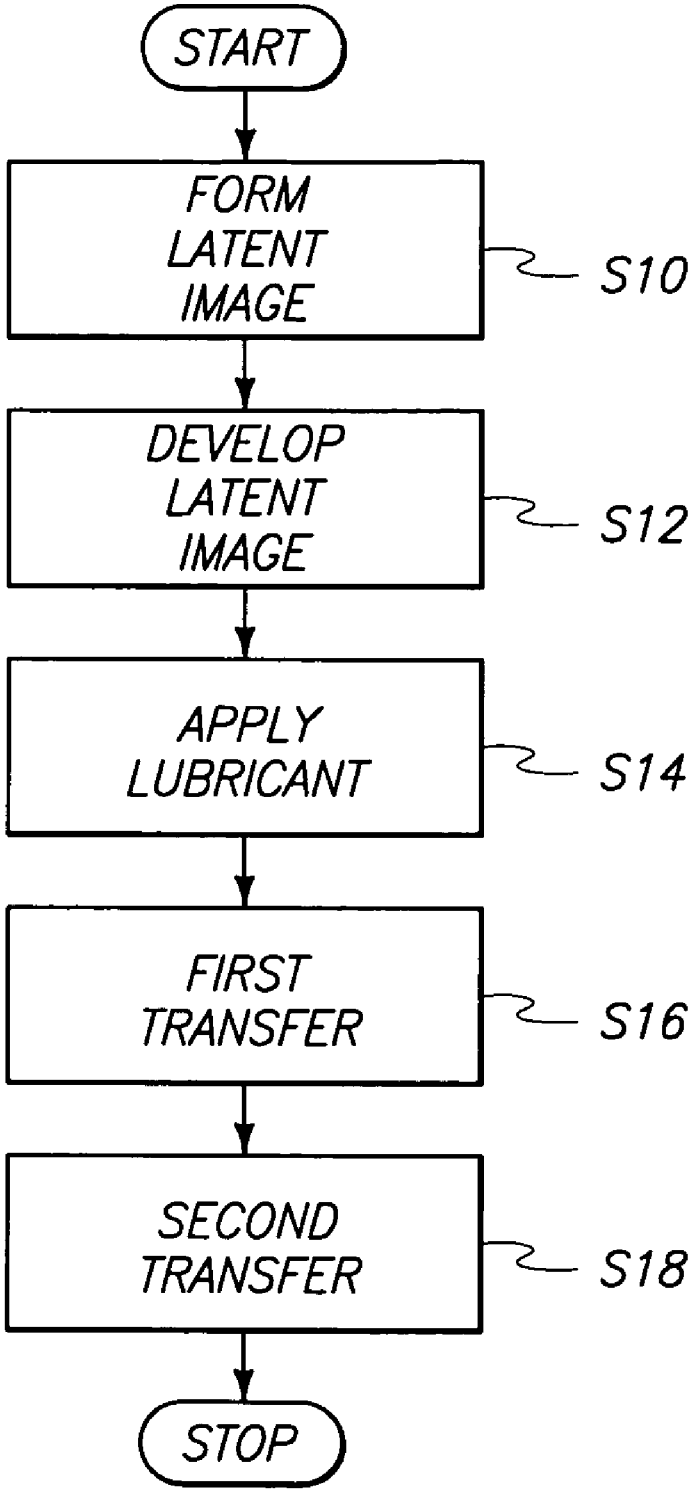
FIG. 5 is a flow chart of an imaging method according to one embodiment.

Referring to FIG. 5, an exemplary electrophotographic imaging method performed by the arrangement of FIG. 3 is depicted according to one embodiment. Other methods are possible including more, less or alternative steps.

At a step S10, a latent image may be formed upon an outer surface of photoconductive drum 22.

At a step S12, the latent images formed upon the outer surface of photoconductive drum 22 may be developed using liquid marking agents comprising a plurality of different colors.

At a step S14, a lubricant may be provided to an outer surface of intermediate transfer drum 24. The lubricant may be provided to portions of drum 24 void of marking agents of developed images in exemplary embodiments as discussed above.

At a step S16, marking agents of developed images are transferred from photoconductive drum 22 to portions of an outer surface of intermediate transfer drum 24 having lubricant thereon.

At a step S18, the marking agents of developed images are transferred from the intermediate transfer drum 24 to media 28 in the depicted embodiment.

At least one exemplary embodiment may provide improved operations compared with imaging device configurations which provide lubricants directly to reservoirs of marking agents which supply the marking agents for use by the imaging device. For example, these imaging devices may have drawbacks in which an outer surface of the developed image on a transfer member may also have the lubrication oil which may decrease an attraction between the developed image and the media which receives the developed image (which may reduce small dot transfer). Further, the image adhesion to media and durability upon media may be reduced and other components of the imaging device may be adversely impacted (e.g., polymerization upon a photoconductor due to relatively high molecular weight of some lubricants). Finally, the presence of lubricant may result in foaming within the reservoirs and different amounts of lubricants between developed images and background areas of images may result in image memory upon the photoconductor.

One or more of the arrangements of the imaging devices of the disclosure may have improved blanket to media durability in background areas of developed images, improved fixing or durability of images upon media and improved transfer to media. Furthermore, it is believed that application of lubricants to the transfer member 14 as described provides an increased number of degrees of freedom to choose lubricant types and concentrations which may provide at least some of the above-mentioned benefits and may otherwise be unsuitable for direct application to marking agents within reservoirs which may damage the imaging process (e.g., ink conductivity, surface properties, ink viscosity, etc.). At least some of the disclosed arrangements may have improved release of developed images from the transfer member, increased lifespan of the transfer member, reduced foaming of marking agents, and reduced transfer member image memory.

The exemplary aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

The protection sought is not to be limited to the disclosed embodiments, which are given by way of example only, but instead is to be limited only by the scope of the appended claims.

What is claimed is:

1. An imaging method comprising:

forming a latent image using a first imaging member;

using a marking agent comprising a liquid carrier and an ink, developing the latent image providing a developed image;

after the developing, first transferring the marking agent of the developed image to an imaging transfer member;

after the first transferring, second transferring the ink of the developed image from the imaging transfer member; and lubricating the imaging transfer member during the first and the second transferrings using a liquid lubricant having a molecular weight higher than a molecular weight of the liquid carrier.

2. The method of claim 1 wherein the lubricating comprises providing a lubricant directly to an outer surface of the transfer member, and wherein the first transferring comprises receiving the marking agent of the developed image upon a portion of the outer surface of the transfer member having the lubricant.

3. The method of claim 2 wherein the providing comprises providing the lubricant to a portion of the outer surface of the transfer member void of the marking agent of the developed image.

4. The method of claim 2 further comprising rotating the outer surface of the transfer member during the first and second transferrings, and wherein the first and the second transferrings comprise transferring at respective ones of first and second locations of the outer surface of the transfer member and the providing comprises providing the lubricant to a third location of the outer surface of the transfer member intermediate the first and second transferrings.

5. The method of claim 1 wherein the first transferring comprises transferring the liquid carrier and the ink of the marking agent to the transfer member.

6. The method of claim 1 wherein the first transferring comprises transferring a plurality of different colors of the ink in a plurality of different respective rotations of the transfer member to form a single color image, and the lubricating comprises lubricating during less than all of the rotations of the transfer member for the single color image.

7. The method of claim 6 wherein the lubricating comprises lubricating only during a first of the rotations of the transfer member to form the single color image.

8. The method of claim 6 wherein the lubricating comprises providing a lubricant only in contact with an outer surface of the transfer member for the single color image.

9. An imaging method comprising:

applying a lubricant to an imaging transfer member;

after the applying, providing a developed image comprising a marking agent upon portions of the imaging transfer member having the lubricant to transfer the developed image comprising the marking agent to the imaging transfer member;

after the providing, releasing the developed image comprising the marking agent from the imaging transfer member to transfer the developed image comprising the marking agent from the transfer member; and wherein the providing comprises providing the developed image comprising a single color image, and wherein the applying comprises applying the lubricant intermittently to the imaging transfer member during the transfer of the single color image to the imaging transfer member.

10. The method of claim 9 wherein the providing the lubricant comprises applying the lubricant to portions of an outer surface of the transfer member void of the marking agent.

11. The method of claim 9 further comprising rotating the transfer member, and wherein the applying comprises applying the lubricant to a first location of an outer surface of the transfer member downstream from a second location of the outer surface where the releasing occurs and upstream from a third location of the outer surface where the providing occurs.

12. The method of claim 9 wherein the releasing comprises releasing the developed image to media configured to receive the developed image, and wherein the lubricant reduces friction between the media and portions of an outer surface of the transfer member void of the marking agent.

13. The method of claim 9 wherein the lubricant reduces adhesion of the developed image to an outer surface of the transfer member to facilitate the releasing of the developed image from the transfer member.

14. The method of claim 9 wherein the providing comprises providing the developed image comprising a liquid marking agent.

15. The method of claim 9 wherein the providing the developed image comprises providing the developed image comprising a plurality of different colors of the marking agent upon the transfer member in a plurality of different respective separations to form the single color image.

16. The method of claim 9 wherein the applying comprises applying the lubricant only once during the formation of the single color image upon the transfer member and only directly to the surface of the transfer member which is void of the marking agent.

17. The method of claim 9 wherein the applying comprises applying none of the lubricant intermediate different colors of the marking agent.

18. An imaging device comprising:

an imaging member configured to provide latent images during imaging operations of the imaging device;

a development assembly configured to develop the latent images of the imaging member using a marking agent to provide developed images corresponding to the latent images;

an imaging transfer member configured to transfer the developed images from the imaging member; and a lubrication assembly configured to provide a lubricant to lubricate the transfer member during the transfer of the developed images using the transfer member, wherein the lubrication assembly does not provide any lubricant on top of the marking agent of the developed images on the transfer member.

19. The device of claim 18 wherein the lubrication assembly is configured to apply a lubricant directly to an outer surface of the transfer member to lubricate the transfer member.

20. The device of claim 19 wherein the lubrication assembly is configured to apply the lubricant to a portion of the outer surface of the transfer member void of the marking agent of the developed images.

21. The device of claim 18 wherein the lubrication assembly is configured to apply the lubricant to the transfer member during a first moment in time of the transfer of the developed images and to not apply the lubricant to the transfer member during a second moment in time.

22. The device of claim 18 wherein the development assembly is configured to use a liquid marking agent to develop the latent images.

23. The device of claim 18 wherein the development assembly is configured to develop the latent images using a plurality of different colors of the marking agent to provide the developed images comprising color images, and wherein the lubrication assembly is configured to provide only a single layer of the lubricant directly to an outer surface of the transfer member for an individual one of the color images comprising a plurality of the different colors of the marking agent.

24. The device of claim 18 wherein the marking agent comprises a liquid carrier and an ink.

25. A transfer assembly comprising:

an imaging transfer member configured to receive a plurality of developed images individually comprising a marking agent which comprises a liquid carrier and an ink, and wherein the imaging transfer member is configured to transfer the developed images to a subsequent imaging member during imaging of the developed images;

a lubrication assembly configured to provide a lubricant to an outer surface of the imaging transfer member during the imaging of the developed images using the imaging transfer member; and wherein the developed images comprise color images individually comprising a plurality of different colors of the marking agent received by the transfer member during a plurality of respective rotations of the transfer member, and wherein the lubrication assembly provides the lubricant directly to the outer surface of the imaging member for only one of the rotations of the transfer member for one of the color images.

26. The assembly of claim 25 wherein the lubrication assembly is configured to apply the lubricant directly to the outer surface of the transfer member during the transfer of the developed images.

27. The assembly of claim 25 wherein the transfer member is configured to directly transfer the developed images to the subsequent imaging member comprising media.

28. The assembly of claim 25 wherein the lubrication assembly is configured to only provide the lubricant directly to the outer surface of the imaging transfer member.

29. A transfer member lubrication assembly comprising:

a supply device configured to supply a lubricant to lubricate an outer surface of an imaging transfer member, the lubricant being configured to increase releasability of marking agents of color developed images from the outer surface of the imaging transfer member to a subsequent imaging member and to reduce friction intermediate portions of the outer surface of the transfer member and portions of the subsequent imaging member which contact the portions of the outer surface of the transfer member;

a transport assembly configured to transport the lubricant from the supply device to the outer surface of the imaging transfer member; and wherein the lubrication assembly is configured to apply the lubricant intermittently to the outer surface of the imaging transfer member for a transfer of one of the color developed images to the imaging transfer member.

30. The assembly of claim 29 wherein the transport assembly is configured to apply the lubricant directly to the outer surface of the transfer member during transfer of the developed images.

31. The assembly of claim 29 wherein the imaging transfer member is configured to transfer the developed images directly to the subsequent imaging member comprising media, and wherein the lubricant is configured to reduce the friction at the portions of the outer surface void of the marking agents of the developed images and to reduce adhesion of the marking agents of the developed images to the outer surface of the transfer member to increase the releasability of the marking agents of the developed images from the outer surface of the transfer member.

32. The assembly of claim 29 wherein the transport assembly is configured to apply the lubricant to the outer surface of the transfer member at a first spatial location downstream from a second spatial location where the marking agents of the developed images are released from the transfer member and upstream from a third spatial location where the marking agents of the developed images are received by the transfer member.

33. The assembly of claim 29 wherein the transport assembly is configured to transport the lubricant to the outer surface of the transfer member to increase releasability of the marking agents of the developed images from the outer surface of the transfer member to the subsequent imaging member and to reduce the friction intermediate the portions of the outer surface of the transfer member and the portions of the subsequent imaging member which contact the portions of the outer surface of the transfer member.

34. The assembly of claim 29 wherein the supply device comprises a reservoir and the transport assembly comprises a roller partially immersed in the reservoir and in contact with the outer surface of the transfer member and configured to transport the lubricant to the outer surface of the transfer member.

35. An imaging method comprising:

forming a latent image using a first imaging member;

using a marking agent comprising a liquid carrier and an ink, developing the latent image providing a developed image;

after the developing, first transferring the marking agent of the developed image to an imaging transfer member;

after the first transferring, second transferring the ink of the developed image from the imaging transfer member;

lubricating the imaging transfer member during the first and the second transferrings;

wherein the first transferring comprises transferring a plurality of different colors of the ink in a plurality of different respective rotations of the transfer member to form a single color image, and the lubricating comprises lubricating during less than all of the rotations of the transfer member for the single color image; and wherein the lubricating comprises providing a lubricant only in contact with an outer surface of the transfer member for the single color image.

* * * * *